US005413422A

United States Patent [19]

Gray et al.

[11] Patent Number: 5,413,422

[45] Date of Patent: May 9, 1995

[54] PRINT WHEELS AND METHODS OF USING SAME

[75] Inventors: Roger M. Gray, Lewisville; Warren K. Shannon, Highland Village, both of Tex.

[73] Assignee: Taurus Impressions, Inc., Mountain View, Calif.

[21] Appl. No.: 102,601

[22] Filed: Aug. 5, 1993

Related U.S. Application Data

[63] Continuation-in-part of Ser. No. 78,792, Jun. 17, 1993.

[51] Int. Cl.[6] ..... B41J 1/22

[52] U.S. Cl. ..... 400/144.2; 400/174; 101/93.19

[58] Field of Search ..... 101/93.15, 93.16, 93.17, 101/93.18, 93.19; 400/140, 70, 144, 144.1, 144.2, 144.3, 166, 174, 175

[56] References Cited

U.S. PATENT DOCUMENTS

| | | | |
|---|---|---|---|
| 1,406,537 | 2/1922 | Choate | 400/120 |
| 1,979,640 | 11/1934 | Roberts, Jr. | 400/21 |
| 3,301,370 | 1/1967 | Miller | 400/120 |
| 4,005,264 | 1/1977 | Humbs et al. | 101/93.19 X |
| 4,037,532 | 7/1977 | Plaza et al. | 101/93.48 |
| 4,044,665 | 8/1977 | Kuhne et al. | 101/21 |
| 4,074,798 | 2/1978 | Berger | 400/174 X |
| 4,128,346 | 12/1978 | Ragland, III | 400/144.2 |
| 4,147,438 | 4/1979 | Sandrone et al. | 400/144.2 |
| 4,308,794 | 1/1982 | Adamoli et al. | 101/93.03 |
| 4,373,436 | 2/1983 | Shenoha | 101/27 |
| 4,416,199 | 11/1983 | Davison | 101/193 |
| 4,462,708 | 7/1984 | Luartes et al. | 400/304 |
| 4,516,493 | 5/1985 | Schemenauer | 101/27 |
| 4,541,746 | 9/1985 | Bobart et al. | 400/144.2 |
| 4,542,690 | 9/1985 | Kikuchi | 101/27 |
| 4,544,289 | 10/1985 | McGourty et al. | 400/154.5 |
| 4,872,773 | 10/1989 | Ueda | 400/144.2 |
| 4,930,911 | 6/1990 | Sampson et al. | 400/28 |

FOREIGN PATENT DOCUMENTS

| | | | |
|---|---|---|---|
| 2834662 | 3/1979 | Germany | 400/144.2 |
| 0163587 | 10/1982 | Japan | 400/144.2 |
| 0107350 | 6/1985 | Japan | 400/144.2 |
| 0211071 | 9/1986 | Japan | 400/144.2 |
| 0238748 | 10/1987 | Japan | 400/144.2 |
| 2152436A | 8/1985 | United Kingdom . | |

OTHER PUBLICATIONS

IBM Tech. Disclosure Bulletin, vol. 22, No. 11, Apr. 1980 "Mean for Identifying One of a Plurality of Impact Print Wheels".

Acromark Hot Stamping System brochure, the Acromark Company, Inc. pre-1986, 6 pages.

Franklin stamping machine brochures, Franklin Manufacturing Corporation, Model 115 11/83 and Super Regal Model 11/79, 2 pages each, pre-1986.

WEGO printer brochure, Precision Machine, Inc. pre-1986, 4 pages.

"Automark Marking Systems" ACEP-J1B Brochure, Defiance Machine and Tool Co., Inc., published Feb., 1985.

"Easymark" Hot Foil Lettering Brochures, Didde Graphic Systems Corporation pre-1986, 9 pages.

*Primary Examiner*—Edgar S. Burr
*Assistant Examiner*—Christopher A. Bennett
*Attorney, Agent, or Firm*—Skjerven, Morrill, MacPherson, Franklin & Friel; Thomas S. MacDonald; Michael Shenker

[57] ABSTRACT

In a print wheel encoding scheme, signs such as reflector strips are arranged on an encoder ring along the print wheel petals. One strip is provided at each petal. The strips are grouped into groups of three or more petals. Each group starts with a reflective strip and terminates with a non-reflective strip, or vice versa. The strips are read by a single optical sensor to provide a reliable mechanism for reading the print wheel I.D., homing the print wheel and detecting print wheel error conditions such as jams or mispositioning.

9 Claims, 13 Drawing Sheets

PRINT WHEELS AND METHODS OF USING SAME

CROSS REFERENCE TO RELATED APPLICATIONS

This application is a continuation-in-part of U.S. patent application Ser. No. 08/078,792, filed Jun. 17, 1993, by Charles T. Groswith, III et al. and entitled "FLAT BED DAISY WHEEL HOT DEBOSSING STAMPER" which is hereby incorporated herein by reference.

BACKGROUND OF THE INVENTION

1. Field of the Invention

The present invention relates to print wheels such as, for example, character wheels used in hot debossing stamper printing machines. More particularly, the invention relates to reliable detection of print wheel fault conditions such as jams and positioning errors. The invention also relates to homing the print wheels and identifying the print wheel type.

2. Description of Related Art

In hot debossing stamper printing machines, type writers and other devices using print wheels, the print wheel is rotated during printing to align the print wheel petal carrying a character with the printer strike hammer. In most applications the print wheel is positioned with an open loop (no feedback) stepper motor. In such a system, there is minimum position feedback associated with the print wheel motion. If the print wheel becomes mispositioned, the print wheel may become damaged and the printing tape may get wasted. For example, if the print wheel gets jammed because, for instance, a petal gets stuck in the print wheel casing or the hammer gets stuck to the petal, severe damage may result when the motor tries to rotate the print wheel. Further, if the print wheel becomes mispositioned because, for example, of a momentary mechanical interference with the casing or the strike hammer, wrong characters will be printed resulting in tape waste. Thus, an early and reliable error detection allowing aborting the printing early when a fault occurs, especially if printing is unattended, is highly desirable.

In one error detection technique, a reflective strip is placed at the base of a "home" petal and other reflective and non-reflective strips are placed near the home petal in a circular arc of, for example, 80° to 90°. The other non-reflective strips identify the print wheel type—the same printing engine may be able to accept different print wheel types with, for example, different fonts. In such a system, the home flag (i.e., the home petal strip) might be readable by an optical sensor on phase A of the print wheel stepper motor and the print wheel type strips may be readable on phase C. When the print wheel is first inserted into the printing engine, the engine rotates the print wheel, determines the home position by reading the sensor on phase A of the stepper motor, and then reads the print wheel type on phase C. The engine then "homes" the print wheel by positioning the home strip beneath the optical sensor. Later, during printing, whenever the print wheel is expected to be in its home position, the engine reads the sensor to make sure that the sensor sees the reflective strip. If the sensor does not see a reflective strip, an error is reported to the operator. The printing stops, allowing the operator to take a corrective action. One type of an encoded print wheel is described in U.S. Pat. No. 4,074,798 issued Feb. 21, 1978 to M. Berger.

In a second error detection technique, only the home reflective strip is present and the above described type information is not utilized.

A drawback of these error detection schemes is that the print wheel could become jammed or mispositioned before it was supposed to be in the home position. The printer would continue to print, potentially ruining the print wheel. Moreover, if there are other reflective strips besides the home strip, print wheel mispositioning could escape detection even when the print wheel was supposed to be in its home position because the sensor could mistake another reflective strip for the home strip.

Thus, there is a need for a more reliable print wheel error detection than the error detection provided by prior techniques.

SUMMARY OF THE INVENTION

The present invention provides reliable error detection techniques. In some embodiments, not only the home strip but other strips on the print wheel, including the print wheel I.D. strips, are monitored during printing to provide error detection. The reflective/non-reflective strips are positioned all around the print wheel to provide position feedback and allow error detection from any print wheel position. The print wheel homing function, the identification of the print wheel type and the detection of the print wheel position errors are created with a single optical sensor.

In particular, in some embodiments, one reflective or non-reflective strip is positioned at each petal. The strips are grouped into groups of, for example, four consecutive petals, twenty groups for an 80-petal print wheel. Each group contains one variable bit of information. The first strip of each group, when the print wheel is read clockwise, is R (reflective), and the last two strips are N (non-reflective). The second strip carrying the information can be either R or N. A sequence of predetermined "marker" groups is followed by a sequence of one or more "sync" groups which is followed by the print wheel I.D. The print wheel I.D. includes several groups, for example, eight groups, each group carrying one bit of the I.D. Then a parity group is provided, and then the home group whose second petal is a reflective petal. This structure limits the kind of reflective/non-reflective strip sequences that can occur during a normal print wheel operation, allowing detection of illegal sequences as errors. Of note, a sequence NR uniquely identifies a boundary between any two groups because such a sequence occurs only when the second strip R of the sequence is the first strip of a group. This allows the print engine to easily synchronize with the four bit groups. During print wheel rotation, the sequence of strips read by the print engine sensor is monitored to provide an early and reliable detection of a print wheel jam or position error. As soon as an error is detected, the printing is stopped and an error message is given to the operator allowing the operator to take corrective action.

In some embodiments, the printing engine is controlled by a microprocessor executing a firmware program. The invention provides the firmware that controls homing the print wheel, reading the print wheel I.D. and performing print wheel position error detection.

DESCRIPTION OF THE PREFERRED EMBODIMENTS

Figure 1:
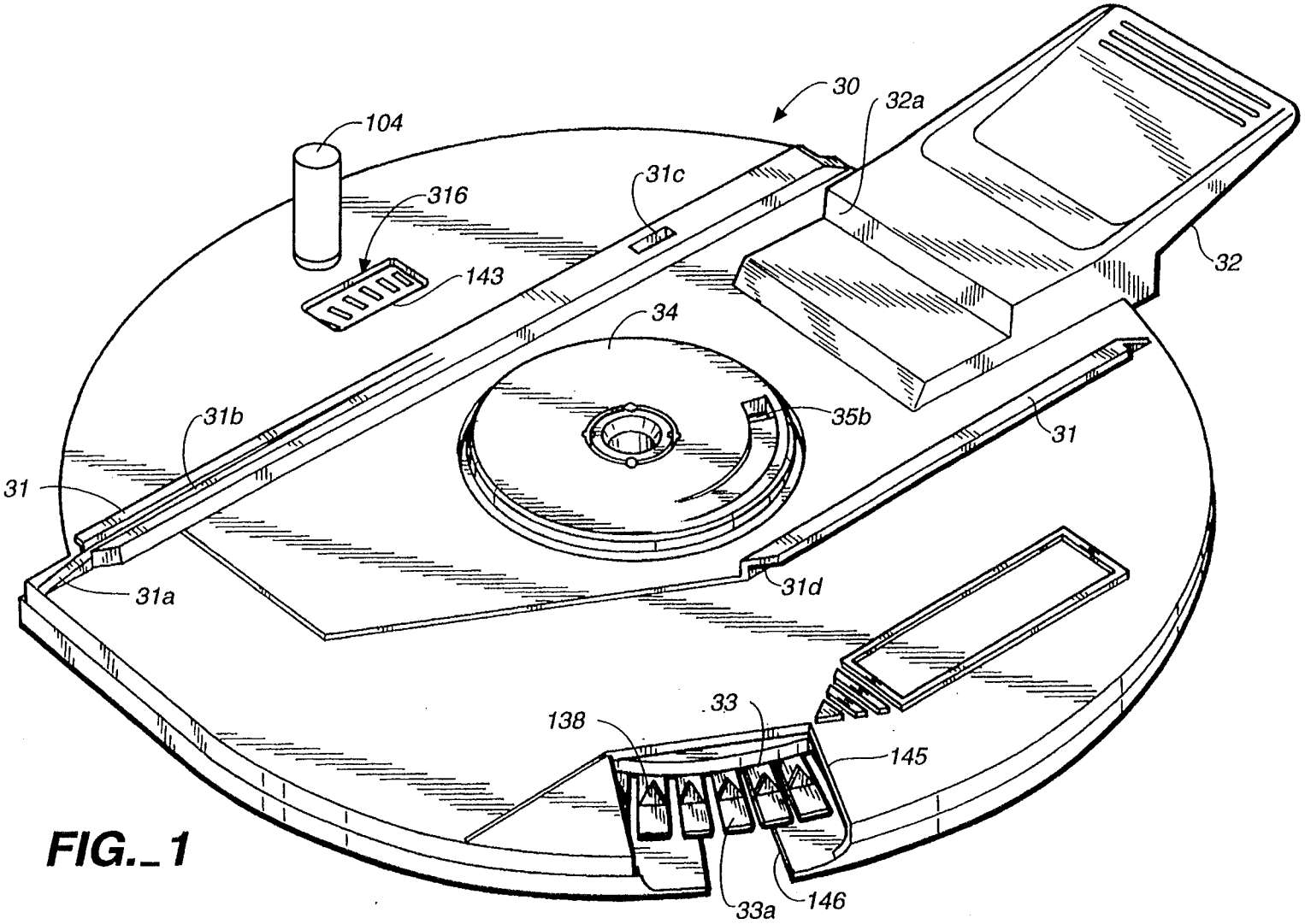
FIG. 1 is a perspective view of a print wheel and casing according to the present invention.

FIG. 1 illustrates a daisy character wheel and casing 30 suitable for a printer such as a hot debossing stamper printing machine. The character wheel and casing includes a pair of spaced parallel guide rails 31 and slots 31*d* which interfit with corresponding slots and rails in the print engine (not shown) as described in the aforementioned U.S. patent application Ser. No. 08/078,792 incorporated herein by reference. One of the linear guide rails 31 which guide the print wheel and casing into the print engine includes ramp surfaces 31*a* and 31*b* as well as a ramp and slot 31*c*. The character wheel and casing includes also an insertion handle 32, a series, typically from 70 to 90, of radial spring fingers or petals 33 each mounting a character-containing pad 33*a* at its radial end and each extending from a wheel hub 34. Hub 34 and its integral character wheel is driven by a stepper motor (not shown in FIG. 1) in the print engine by a motor drive pin 147*a* (FIG. 2) guided by a circular arc entrance ramp 35*a* on the hub top surface into a rectangular drive and homing slot 35*b* in the hub. The top surface of the casing includes a strike window 145 and a casing window 143 for optical access of an optical sensor 104 to sense alternating reflective and non-reflective 6 signs (surfaces) 316 on the character wheel indicating homing of the print wheel and indicating the presence and identification code of the print wheel. In some embodiments, sensor 104 is of type OMRON, Model #EE-SB5 manufactured by Omron of Osaka 541, Japan. The bottom surface includes a radial triangular slit 146 for depressed character finger passage. Each finger pad 33*a* includes a triangular ridge 138 on its top surface for character centering.

Drive shaft 37*b* (FIG. 2) of the stepper motor drives spur gear 37*a*. Gear 37*a* drives central gear 37 which is molded to the wheel drive shaft 36 movable into the print wheel hub 34. Locator pin 147*a* extends from under a peripheral portion of gear 37 which upon rotation enters the print wheel hub ramp 35*a* and slot 35*b* on the top of the print wheel casing. Gear 37*a* does not move up or down but is in continuous engagement with gear 37 which does move up and down with the shaft 36 with its teeth sliding up and down on the meshing teeth of gear 37*a*. The shaft 36 moves up to clear the print wheel hub 34 by operation of a mechanical linkage (not shown) actuated by the print wheel insertion. A curved leaf spring 147 is attached to the top surface of gear 37 and has a distal end fixedly mounting the locator/locking pin 147*a* which due to its spring movement moves up and down and along the ramp 35*a* into the thru-notch or slot 35*b* in the hub 34 at the end of the ramp. A bottom nose 36*a* of the shaft 36 extending under gear 37 engages into the print wheel center aperture 34*a* for centering. When the daisy character wheel and case is inserted into the print engine the spring-pressed locator pin 147*a* rides above hub 34 on the top of the character wheel casing and the gear 37 is rotated counterclockwise so that the locator pin 147*a* slides down the ramp 35*a* until it drops into the rectangular thru-slot 35*b* and stays there by spring pressure from spring 147. The gear makes a slow revolution in the direction of ramp 35*a* with the pin at an intermediate vertical position until it finds the slot 35*b*. This places cylindrical drive pin 147*a* at a predetermined "home" portion of the wheel in the casing. The hub and attached wheel can then be driven in either rotational direction to rotate the print wheel in that direction so as to reach the particular character to be printed in the shortest elapsed time.

Figure 3:
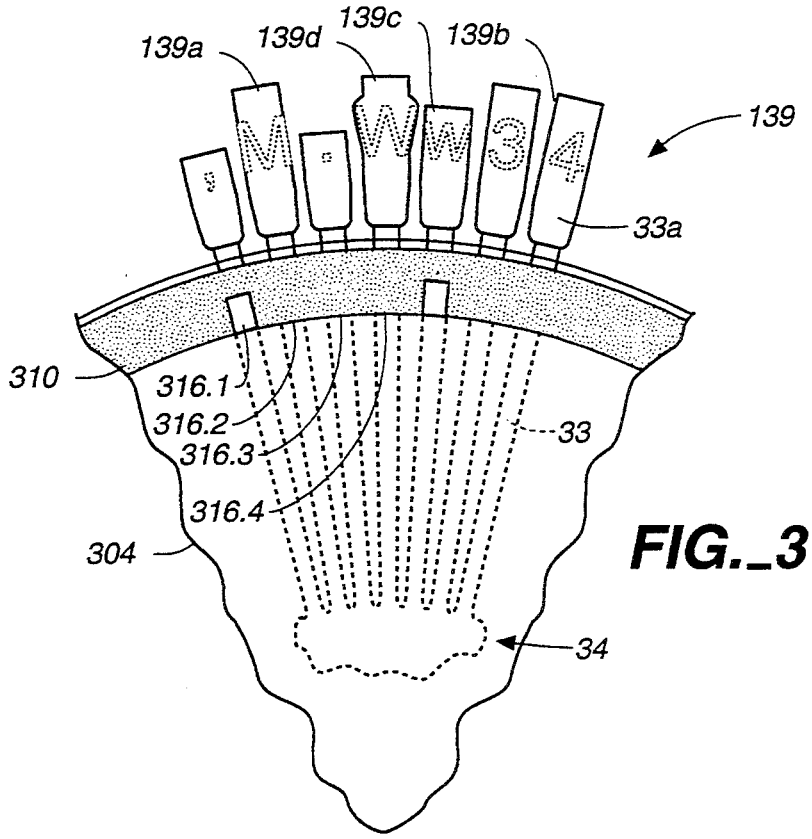
FIG. 3 is a partial top view of an arc of several character fingers showing character pads and also showing an encoder ring with reflective/non-reflective strips.

FIG. 3 illustrates the top side of a number of character wheel fingers (or petals) showing metal petals 33, character pads 33*a* welded thereto, and characters 139 underneath the character pads. Plastic encoder disk 304 is mounted on top of hub 34 and fingers 33. Encoder ring 310 on the periphery of encoder disk 304 completely surrounds a center portion of the print wheel. The encoder ring carries signs such as signs 316.1 through 316.4 running generally in one plane with the petals. Signs 316 are readable by an optical sensor (not shown) through the casing window 143 (FIG. 1). Each sign is a reflective or non-reflective strip extending radially over a respective petal along the petal centerline. There is one such strip at the base of each petal. (A non-reflective strip is the absence of a reflective strip in some embodiments.)

Encoder disk 304 has tooling holes (not shown) for insertion of pins (not shown) on hub 34 to align precisely each strip 316 with a respective petal centerline. Pins (not shown) on the encoder disk mate with holes 402*a*, 402*b* (FIG. 4) on ring 310 to achieve precise ring positioning. Disk 304 rotates with the hub and the metal fingers, but disk 304 is not attached directly to the fingers and hence does not prevent the fingers from bending down when struck by the strike hammer (not shown). Such an encoder disk fixture is shown in the aforementioned U.S. patent application Ser. No. 08/078,792.

Figure 4:
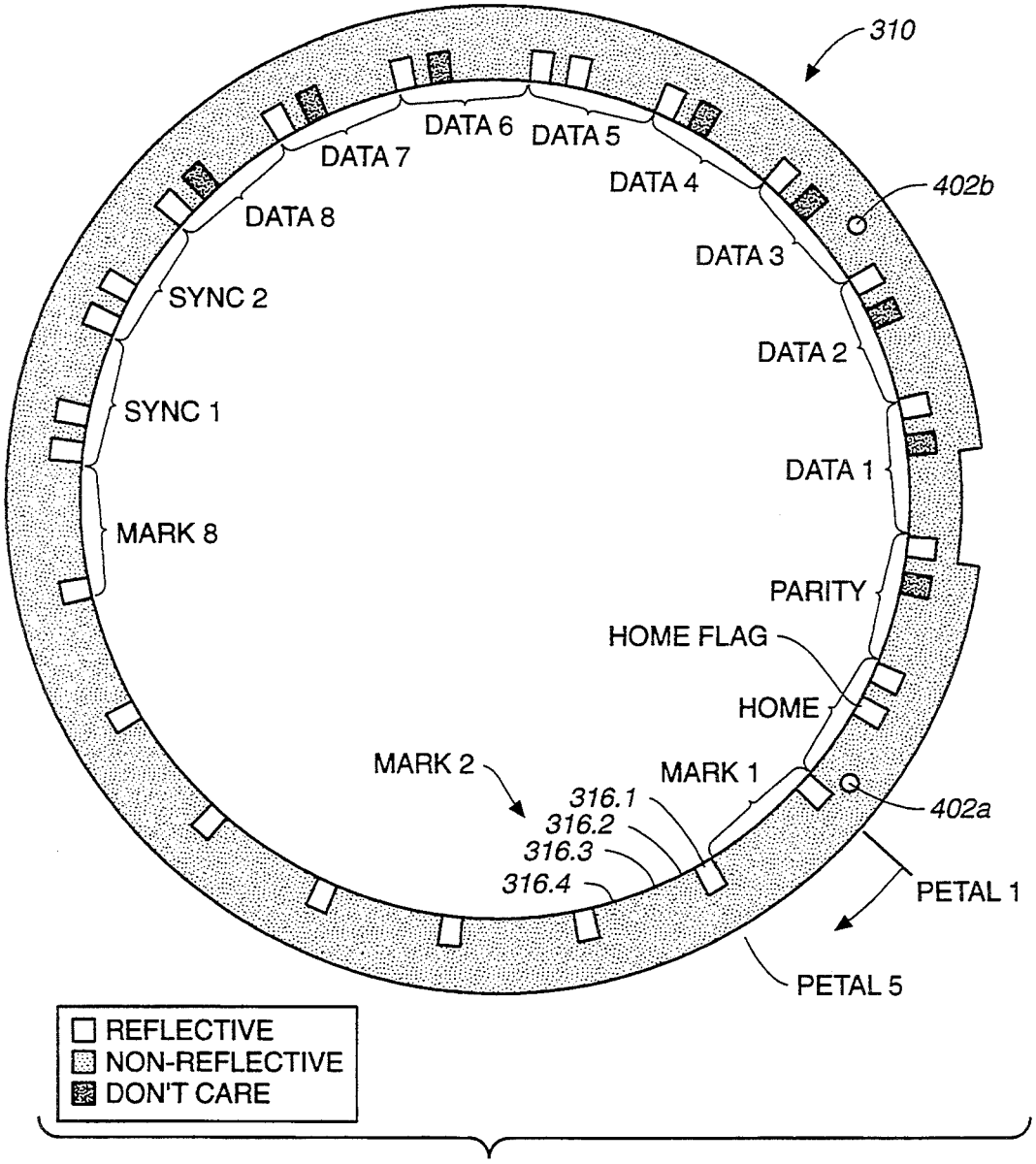
FIG. 4 is a plan view of the encoder ring.

FIG. 4 illustrates encoder ring 310 in more detail. All the strips 316 are divided into groups ("quads") of four strips. Each group, when examined clockwise, contains four consecutive strips of the form R I N N, where "R" means reflective, "N" means non-reflective, and "I" means either reflective or non-reflective. For example, group "MARK 2" includes strips 316.1 through 316.4 of the form R N N N. Group "SYNC 1" is of the form R R N N. Each data group carries one bit of information as defined by the strip "I".

Thus, each group corresponds to four petals. A "marker" reflective strip, which is the first strip of each group, is placed on every fourth petal, for a total of 20 markers. A 216 degree pie-wedge (12 markers) including all the groups except "MARK 1" through "MARK 8" carries the encoding information as reflector flags (strips) "I" on the petals immediately following those markers. The following Table 1 shows the reflector states of all 80 petals for a typical print wheel. In this Table, "R" means reflective, "N" means non-reflective "D", means either reflective or non-reflective depending upon the particular print wheel I.D. code, and "P" means either reflective or non-reflective depending on parity.

TABLE 1

| Petal#: | | | | | | | | | | | | | | | | | | | |
|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 |
| R | N | N | N | R | N | N | N | R | N | N | N | R | N | N | N | R | N | N | N |
| MARK 1 — | | | | MARK 2 — | | | | MARK 3 — | | | | MARK 4 — | | | | MARK 5 — | | | |

| Petal#: | | | | | | | | | | | | | | | | | | | |
|---|---|---|---|---|---|---|---|---|---|---|---|---|---|---|---|---|---|---|---|
| 21 | 22 | 23 | 24 | 25 | 26 | 27 | 28 | 29 | 30 | 31 | 32 | 33 | 34 | 35 | 36 | 37 | 38 | 39 | 40 |
| R | N | N | N | R | N | N | N | R | N | N | N | R | R | N | N | R | R | N | N |
| MARK 6 — | | | | MARK 7 — | | | | MARK 8 — | | | | SYNC 1 — | | | | SYNC 2 — | | | |

| Petal#: | | | | | | | | | | | | | | | | | | | |
|---|---|---|---|---|---|---|---|---|---|---|---|---|---|---|---|---|---|---|---|
| 41 | 42 | 43 | 44 | 45 | 46 | 47 | 48 | 49 | 50 | 51 | 52 | 53 | 54 | 55 | 56 | 57 | 58 | 59 | 60 |
| R | D | N | N | R | D | N | N | R | D | N | N | R | R | N | N | R | D | N | N |
| DATA 8 — | | | | DATA 7 — | | | | DATA 6 — | | | | DATA 5 — | | | | DATA 4 — | | | |

| Petal#: | | | | | | | | | | | | | | | | | | | |
|---|---|---|---|---|---|---|---|---|---|---|---|---|---|---|---|---|---|---|---|
| 61 | 62 | 63 | 64 | 65 | 66 | 67 | 68 | 69 | 70 | 71 | 72 | 73 | 74 | 75 | 76 | 77 | 78 | 79 | 80 |
| R | D | N | N | R | D | N | N | R | D | N | N | R | P | N | N | R | R | N | N |
| DATA 3 — | | | | DATA 2 — | | | | DATA 1 — | | | | PARITY — | | | | HOME — | | | |

As seen in Table 1, the groups include eight marker groups MARK 1 through MARK 8, two sync groups SYNC 1, SYNC 2, eight data groups DATA 8 through DATA 1, one parity group and one home group.

Marker Groups: Petals 1 though 4 represent a typical marker group "MARK 1". The "I" strip is non-reflective. The eight consecutive marker groups "MARK 1" through "MARK 8" take up 144 degrees of the print wheel circumference (petals 1 through 32).

Sync Groups: Petals 33 through 36 represent a typical sync group. The "I" strip is reflective. The two sync groups (petals 33 through 40) signal the transition between the marker groups and the data groups.

Data Groups: These groups carry the print wheel I.D. Petals 41 through 44 represent a typical data group. The "I" strip D can be either reflective (corresponding to a binary digit "0") or non-reflective (binary digit "1"), depending upon the print wheel I.D. Note that the fourth data bit D (in group DATA 5) is ALWAYS binary "0" (petal 54 is reflective). This is done in order to eliminate certain print wheel I.D. codes from making the data bit section look like the marker section. More particularly, putting a reflective strip at petal 54 breaks up any long string of non-reflective "I" strips in the I.D., preventing the print wheel I.D. from being mistaken for the eight marker groups. As a result, any sequence of consecutive non-marker groups having non-reflective "I" strips has fewer groups than the number (8) of the marker groups so that the marker groups can be uniquely identified.

The print wheel I.D. is formed from a binary-weighted summation of data bits 1 through 8 (i.e, D bits of groups DATA 1 through DATA 8) as shown below:

| Data Bit # | Occurs on Petal # | Has weight of |
|---|---|---|
| 8 | 42 | 128 |

-continued

| Data Bit # | Occurs on Petal # | Has weight of |
|---|---|---|
| 7 | 46 | 64 |
| 6 | 50 | 32 |
| 5* | 54* | 16* |
| 4 | 58 | 8 |
| 3 | 62 | 4 |
| 2 | 66 | 2 |
| 1 | 70 | 1 |

*Data Bit 5 is always "0".

Parity Group: Following the eight data groups is a single parity group. The state of the second petal "P" of the parity group (reflective vs. non-reflective) is a function of the print wheel I.D. according to the following rule:

If, in the eight data bits, there are an odd number of reflective bits (binary 0's), then the parity bit "P" is reflective (binary 0).

Otherwise, the parity bit is non-reflective (binary 1).

Home Group: The home group has the same construction as a sync group, i.e., the corresponding "I" bit is reflective. Anytime the print wheel is at the "home" position, the reflective strip on petal #78 is directly underneath the print wheel sensor. If the sensor does not sense a reflecting strip, an error is reported to the host computer ("print wheel lost home").

Figure 5:
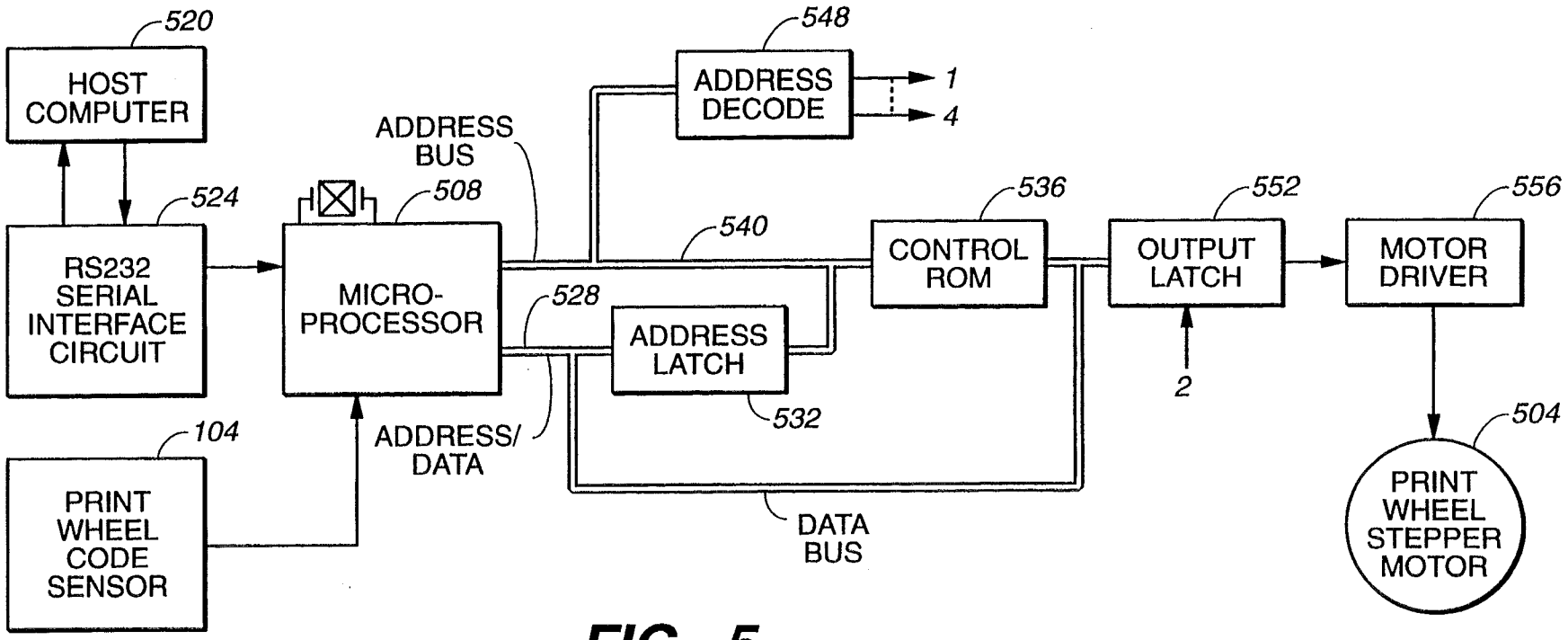
FIG. 5 is a block diagram of the printer electronics responsible for the print wheel operation.

FIG. 5 illustrates the printer electronics portion responsible for control of the print wheel stepper motor 504. Microprocessor 508 controlling the stepper motor communicates with host computer 520 through RS232 serial interface circuit 524. The microprocessor data bus is multiplexed with a portion of the address bus. The multiplexed address/data bus is shown at 528. The address signals on bus 528 are latched by an address latch 532 and provided to the control ROM 536 together with the address signals on address bus 540. Control ROM 536 stores the firmware executed by microprocessor 508. The address signals on bus 540 are decoded by address decoder 548 whose outputs control various latches including the latch 552. Latch 552 controls motor driver 556 which drives the stepper motor 504. Print wheel code sensor 104 is connected to microprocessor 508 so that the sensor can be read by the microprocessor.

Other details of the printer electronics are disclosed in the aforementioned U.S. patent application Ser. No. 08/078,792 incorporated herein by reference.

HOMING THE PRINT WHEEL

Figure 6:
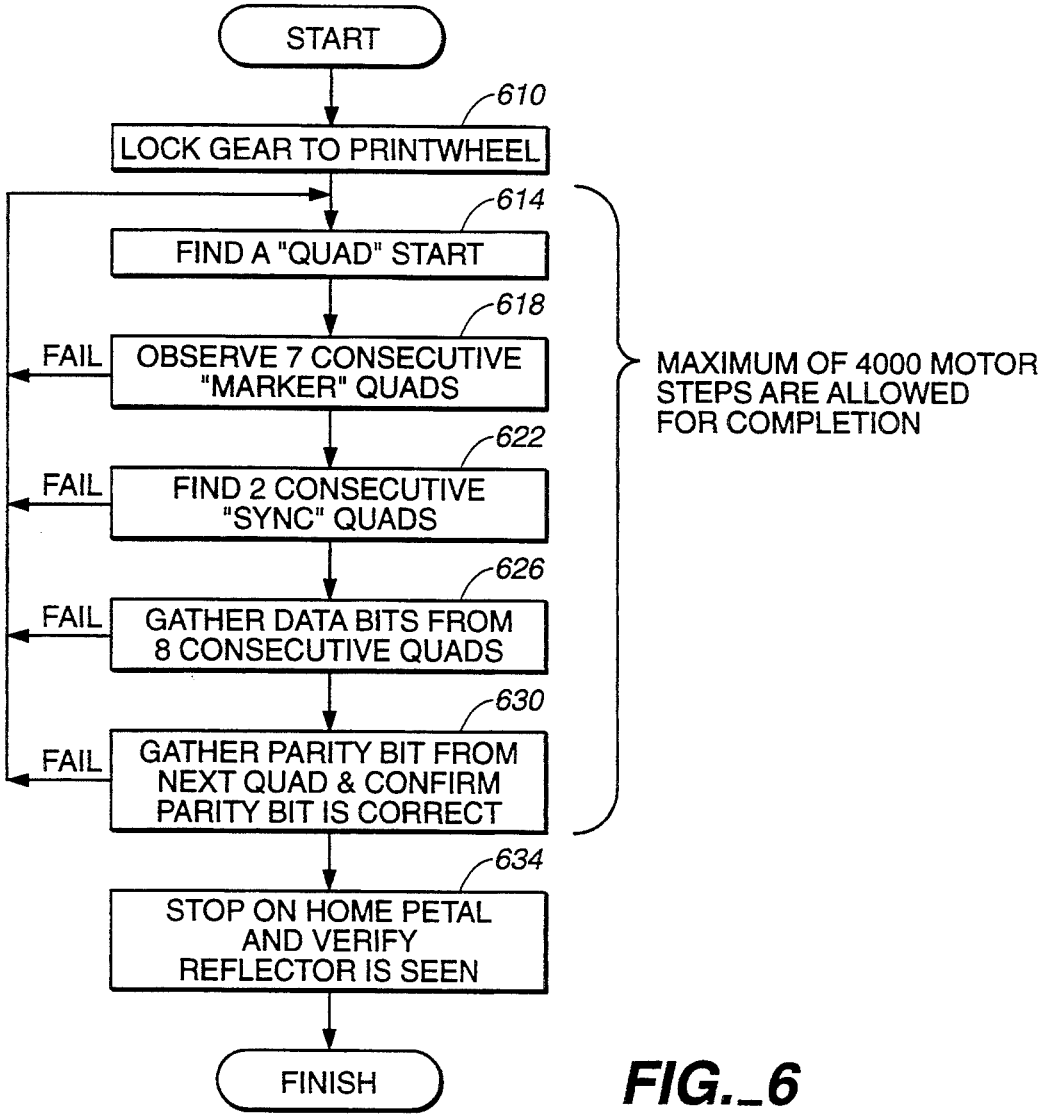
FIG. 6 is a flow chart of the firmware that homes the print wheel and reads the print wheel I.D.

FIG. 6 illustrates the firmware used to home the print wheel. At step 610, stepper motor 504 is spun for slightly more than one print wheel revolution to allow the print wheel gear to mechanically engage the print wheel via spring-loaded pin 147*a* which drops into thru-slot 35*b* in the print wheel's hub. After one rotation, it is assumed that the print wheel is locked to the main print wheel gear and is spinning.

Next, at step 614, the firmware locates the beginning of some group of four strips to synchronize with a group.

Next, the print wheel code sensor feedback is monitored. At step 618, the firmware locates seven consecutive "marker patterns" (marker groups). More particularly, because data bit 5 (FIG. 4) is reflective, the longest string of non-reflective non-marker-group "I" bits occurs when data bits 4 through 1 and the parity bit are non-reflective. This would be a string of five groups which resemble marker groups. For this reason, a string of six or more non-reflective bits "I" identify the marker groups. The embodiment being described requires a string of seven non-reflective "I" bits to identify the marker groups.

If seven consecutive marker groups are not found, it is assumed that the firmware may have incorrectly determined the group boundary at step 614, and control returns to the start of step 614.

Once seven marker groups have been seen, the two sync groups are searched for at step 622. Of note, encountering these sync groups "fixes" the position of the home group which is located at a predetermined position relative to the two sync groups.

If two consecutive sync groups are not found, control returns to step 614.

After the two sync patterns have been found, the next eight patterns are read at step 626 as the print wheel I.D. data patterns. The eight binary bits are accumulated in a memory location in the microprocessor.

If an invalid data pattern is read, control returns to step 614.

Once the eight data bits have been collected, the next pattern is read at step 630 as the parity bit pattern. If the parity is incorrect, control returns to step 614.

Only 4,000 stepper motor steps are allowed for steps 614 through 630 of FIG. 6. 4,000 motor steps are slightly more than four revolutions of the print wheel as each revolution corresponds to 960 motor steps. If after 4,000 steps the firmware has not successfully read the parity bit, an error message is sent to the host computer and the homing attempt is aborted.

After the parity bit has been read and is correct, the print wheel at step 634 comes to a stop on the home flag (i.e., strip "I" of the home group). If the home flag is reflective, the printer firmware reports the print wheel I.D. to the host computer and printing can begin. If not, an error message is sent to the host computer and the homing attempt is aborted.

A more detailed description of the print wheel homing firmware is provided below.

STEPPER MOTOR CONTROL

The stepper motor 504 is a 200 step/revolution motor (or 1.8 degrees/step). The motor is mechanically geared to the print wheel such that one revolution of the print wheel requires 4.8 revolutions of the stepper motor. Thus, one revolution of the print wheel is equivalent to 960 motor steps (200 * 4.8=960).

The windings of the two-phase hybrid stepper motor are referred to below as Winding X and Winding Y. At any point in time, these windings can be in one of 4 states, or "phases", depending on the direction (±) of the current in the windings:

| | WINDING X STATE | WINDING Y STATE |
|---|---|---|
| PHASE A | − | − |
| PHASE B | − | + |
| PHASE C | + | + |
| PHASE D | + | − |

Figure 2:
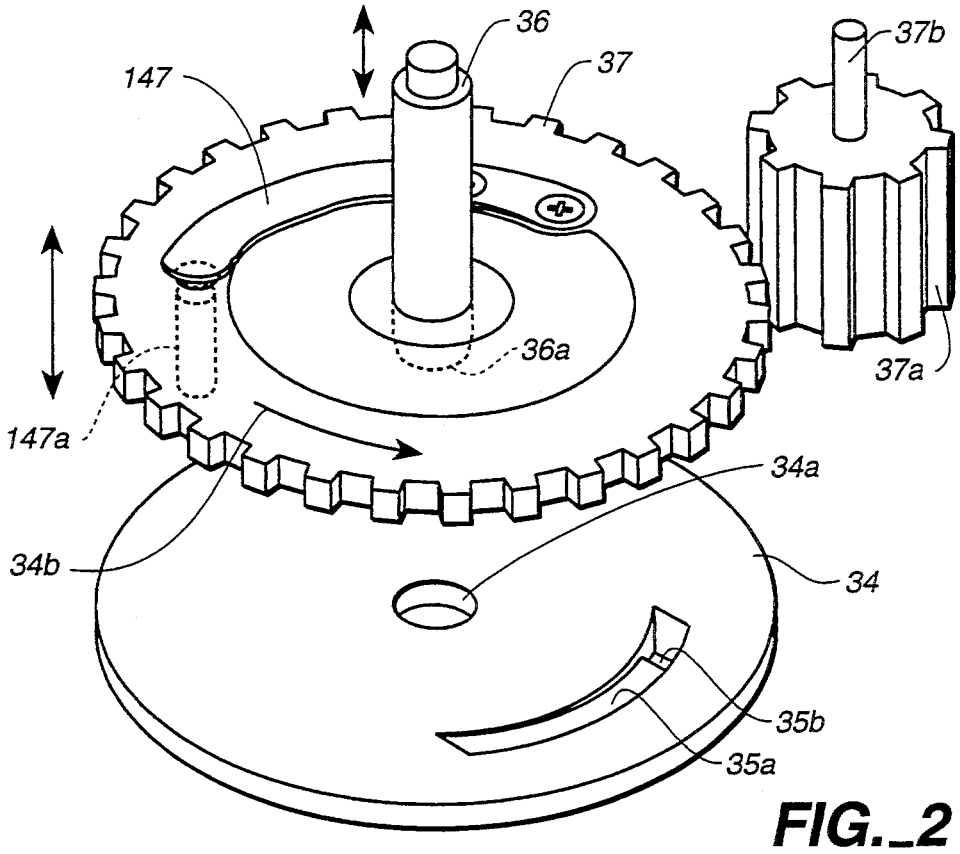
FIG. 2 is a perspective schematic view of the character wheel ramp slot drive mechanism.

As the stepper motor is rotated, the electrical sequence progresses in the following fashion in the homing direction, i.e. counterclockwise direction of spin in FIGS. 1, 2 and 4 as the sensor reads the print wheel in the clockwise direction:

PHASE A, PHASE B, PHASE C, PHASE D,
PHASE A, PHASE B, . . .

or, in the opposite direction of spin, the sequence is:

PHASE A, PHASE D, PHASE C, PHASE B,
PHASE A, PHASE D, . . .

Since there are 960 motor steps in one rotation of the print wheel, and there are 80 petals on the print wheel, there are 12 motor steps between adjacent petals (960/80=12). In phase notation, assuming that the petal centerlines are aligned to PHASE A (as is done at manufacturing time in some embodiments), this means:

PHASE A B C D A B C D A B C D A B C D A B C. .
spoke spoke ("Spoke" and "petal" are equivalent as used herein.) As seen, a print wheel petal centerline occurs on every third "phase A" of the stepper motor. Therefore, in order to "see" the reflective or non-reflective strip, the print wheel sensor state is read when the stepper motor is mechanically positioned at phase A to ensure that the sensor is reading on the spoke centerline, and in the middle of the reflective strip if one is present.

Of note, it is desirable to read the sensor when the motor is mechanically positioned at phase A. However, the electrical excitation of the motor's windings leads the mechanical position of the motor by approximately one motor phase, or stated differently, the mechanical position of the motor lags its electrical position by approximately one motor phase. This implies that, during motion, the electrical and mechanical phases of the motor have the following relationships:

When spinning in the recall (homing, or counterclockwise) direction:

ELECTRICAL POSITION A B C D A B C D A B C . . .
MECHANICAL POSITION . . A B C D A B C D A B C . . .

When spinning in the opposite direction:

ELECTRICAL POSITION A D C B A D C B A D C . . .
MECHANICAL POSITION . . A D C B A D C B A D C . . .

When spinning in the homing direction (the first case above), monitoring the optical feedback sensor when the motor is mechanically positioned at phase A requires reading the sensor when the motor is electrically at phase B, that is, when the microprocessor has put out phase B to the motor. Hence during homing, all optical feedback sensor readings are made when the motor is electrically at phase B. In fact, as the print wheel is rotated, each and every state of the reflective feedback at electrical phase B is captured and stored. The patterns of reflective/non-reflective states thus obtained are compared to the patterns necessary for proper print wheel homing.

In monitoring for a "group of 4" (or "quad"), 12 consecutive phase B states (corresponding to 4 print wheel petals) are gathered, and patterns of 12 phase-B's are checked against legal quad sequences. As a specific example, suppose the following quad petal pattern (a sync pattern) is being checked for:

R R N N

Although only 4 reflective petal states are being checked, 12 phase B sensor states are being gathered. These 12 sensor states must correspond to the following pattern:

```
PETAL PATTERN:      R     R     N     N
PHASE B PATTERN:    R X X R X X N N N N N N
PETAL CENTERLINE    |     |     |     |
```

where the extra sensor states in the phase B pattern correspond to the "off petal-centerline" B-phase states.

Figure 7:
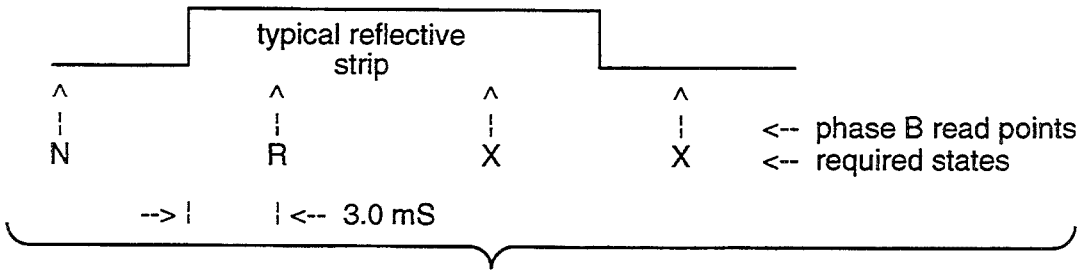
FIG. 7 illustrates schematically the print wheel stepper motor alignment relative to a reflective strip.

Of note, when the print wheels and printers are assembled, the encoder strip on the print wheel and the sensor block on the printer are adjusted such that the phase B read point occurs safely inside the leading edge of all reflector strips. See FIG. 7. Specifically, the mechanism is adjusted in some embodiments such that the phase B read point occurs approximately 3 milliseconds past the leading edge of the reflective strip at homing velocity. The entire reflective strip is approximately 12 milliseconds wide, as illustrated by FIG. 7.

HOMING THE PRINT WHEEL (continued)

Figure 8:
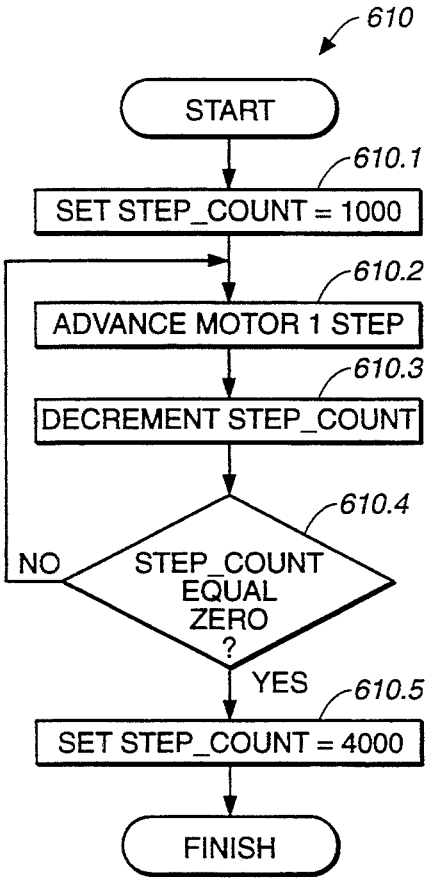
FIGS. 8–14 are flow charts illustrating in detail some steps of the flow chart of FIG. 6.

Step 610 is illustrated in FIG. 8. At step 610.1, a variable STEP_COUNT is set to 1,000. STEP COUNT holds the number of the remaining motor steps allowed for step 610. At step 610.2, the motor is advanced one step to rotate the print wheel clockwise. At step 610.3, STEP COUNT is decremented. At step 610.4, a check is made whether STEP_COUNT=0. If not, control returns to step 610.2. If STEP_COUNT=0, control passes to step 610.5. STEP_COUNT is set to 4,000 which is the maximum number of the motor steps allowed for the firmware steps 614 through 630 (FIG. 6). Firmware step 610 is then terminated.

In steps 614 through 630, the print wheel rotates counterclockwise. The variable STEP COUNT is decremented on every stepper motor step. On every step, STEP_COUNT is compared to 0. If and when STEP_COUNT=0 while step 630 is not successfully completed, the homing attempt is aborted and an error message is sent to the host computer.

Figure 9:
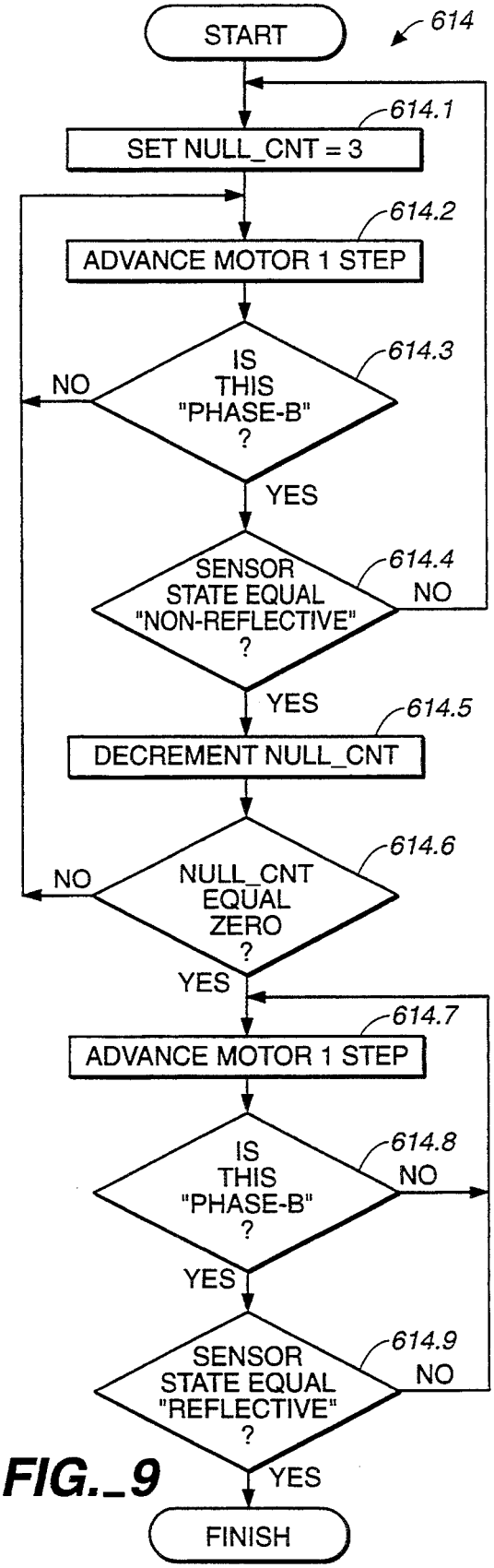

At step 614 (FIGS. 6, 9), the firmware synchronizes with a "group of 4" strips (or "quad"). As discussed above, the legal sequence of reflector strips when rotating in the homing direction is:

```
R X N N R X N N R X N N . . . , where "X" is don't care.
| ---- | | ---- | | ---- | . . . , indicating "groups of 4"
```

In order to get in sync with a quad, the reflective feedback is monitored to find the pattern N R. As can be seen by studying the legal (valid) sequences of reflector strips, when a non-reflective petal is followed by a reflective petal, the reflective petal MUST be the beginning of a quad.

At step 614.1, a search is started for at least three consecutive non-reflective "phase-B" sensor readings. Three consecutive "phase-B" readings correspond in width to one petal as described above. A variable NULL_CNT is set to 3. This variable will contain the number of the remaining consecutive non-reflective phase-B readings desired.

At step 614.2, a stepper motor is advanced by one step. Then, if the motor is not at phase B (step 614.3), control returns to step 614.2. Otherwise, at step 614.4, the sensor is read. If the sensor state is reflective, control returns to step 614.1. Otherwise, at step 614.5, NULL_CNT is decremented. If at step 614.6 it is discovered that NULL_CNT is not yet zero, control returns to step 614.2. Otherwise, three consecutive non-reflective phase-B states have been encountered, and control passes to step 614.7.

A search is now made for the first reflective strip. Such a strip will signify the beginning of a quad. The motor is advanced at step 614.7 until the motor is at phase B as determined at step 614.8. Then the sensor is read at step 614.9. If the sensor state is reflective, step 614 terminates. Otherwise, control returns to step 614.7.

Step 618 consists of looking for seven consecutive marker patterns, each having the quad form R N N N. If any quad fails to correspond to this marker pattern, the firmware returns to step 614. Once seven consecutive marker patterns are seen, step 618 is complete.

Figure 10:
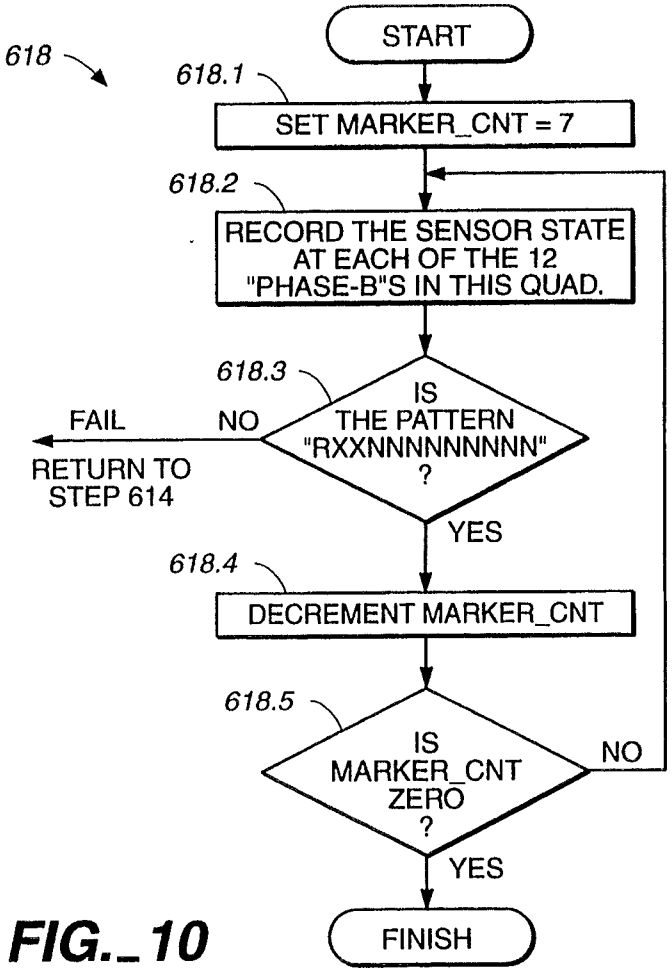

Step 618 is illustrated in FIG. 10. At step 618.1, a variable MARKER_CNT is set to 7. At step 618.2, the print wheel is advanced and the sensor state is recorded at each of the twelve consecutive phase-B's of the current quad. At step 618.3, the sequence of twelve phase-B's is compared with RXXNNNNNNNNN where X is "don't care", that is, either reflective or non-reflective. As explained above, a petal corresponds to three states in such a sequence. A non-reflective petal corresponds to NNN. A reflective petal corresponds to RXX (see FIG. 7). Thus the marker pattern corresponds to RXXNNNNNNNNN. If the pattern read from the sensor is not equal to the marker pattern, control returns to step 614. Otherwise, the variable MARKER_CNT is decremented at step 618.4 and compared to zero at step 618.5. If the variable is equal to zero, seven marker patterns have been read, and step 618 terminates. Otherwise control returns to step 618.2.

Figure 11:
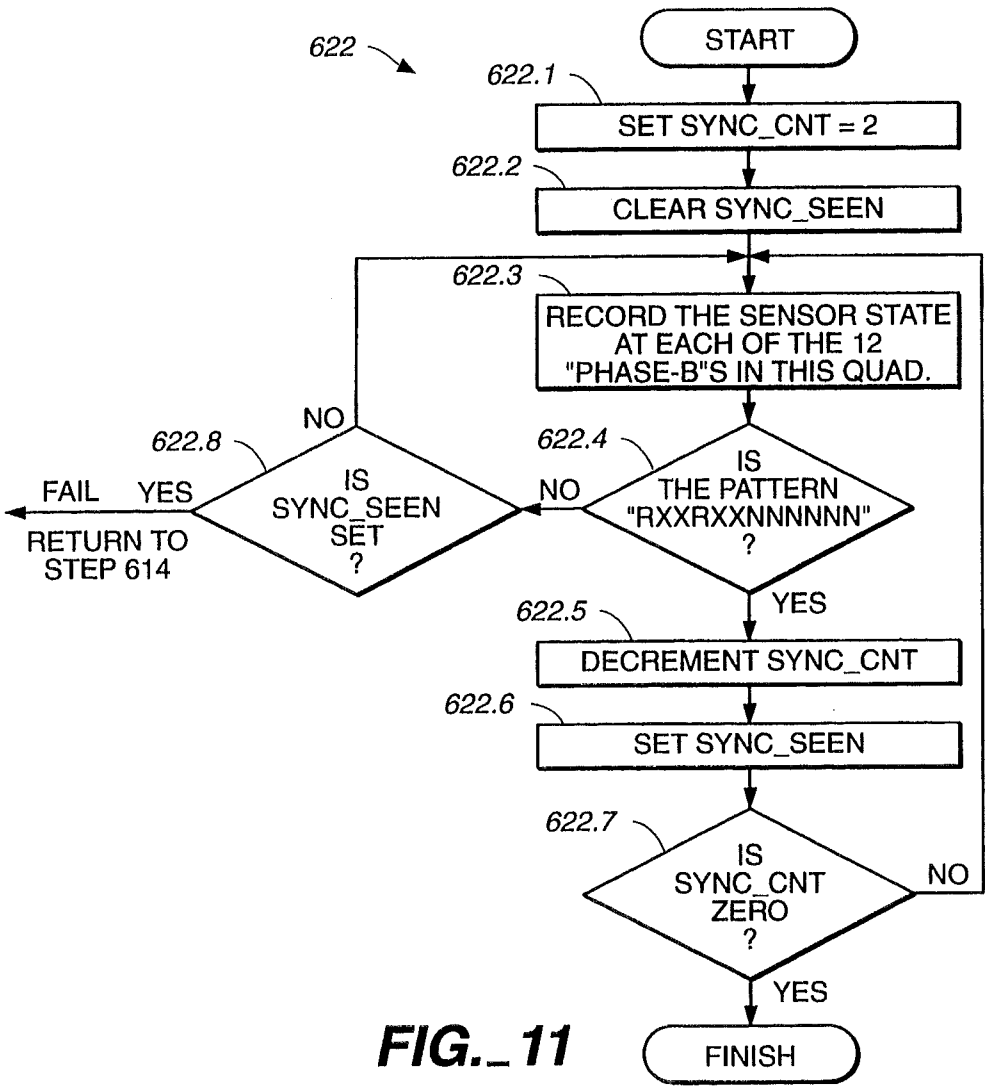

Step 622 (FIGS. 6, 11) consists of looking for two consecutive sync patterns, each having the quad form

R R N N.

Of note, the encounter of these two sync patterns "fixes" the final stopping position, and thus the print wheel "home" position, based upon the design layout of the print wheel encoder strip. If the first sync pattern is not immediately followed by the second sync pattern, the firmware returns to step 614.

At step 622.1 (FIG. 11) a variable SYNC_CNT is set to 2. At step 622.2, a flag SYNC_SEEN is cleared. At step 622.3, twelve consecutive phase-B sensor states are read for the current quad. At step 622.4 the twelve states are compared with the sync pattern RXXRXXNNNNNN. If a match occurs, SYNC_CNT is decremented at step 622.5, and the flag SYNC_SEEN is set at step 622.6. If it is determined at step 622.7 that SYNC_CNT=0, step 622 is terminated. Otherwise, control returns to step 622.3.

If at step 622.4 the twelve sensor states are not equal to the sync pattern, control passes to step 622.8. If the flag SYNC_SEEN is set, one sync pattern has been encountered but the following quad is not a sync quad. Control then returns to step 614. If SYNC_SEEN is clear at step 622.8, control returns to step 622.3.

Figure 12:
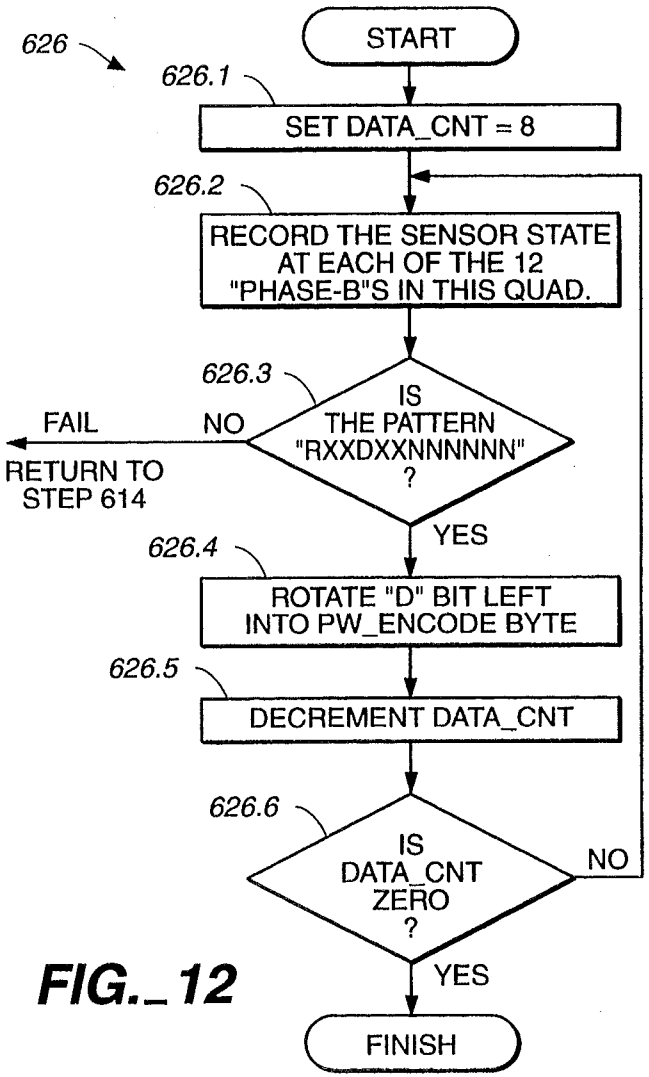

Step 626 (FIGS. 6, 12) consists of gathering the next eight data quads each of which has the pattern R D N N. The D bits of the data quads are assembled to form the print wheel I.D. binary code. Should any quad pattern fail to conform to the pattern R D N N, the firmware returns to step 614. Once all the eight data bits have been gathered, step 626 is complete.

At step 626.1, a variable DATA_CNT is initialized to 8. At step 626.2, the sensor state is read at twelve consecutive phase-B's of the current quad. At step 626.3, the twelve sensor states are compared against the pattern RXXDXXNNNNNN, where D and X can be any values. If a match is not found, control returns to step 614. Otherwise, at step 626.4 the bit D is rotated into the 8-bit variable PW_ENCODE.

At step 626.5, DATA_CNT is decremented. If at step 626.6 DATA_CNT is 0, step 626 is terminated. Otherwise control returns to step 626.2.

Figure 13:
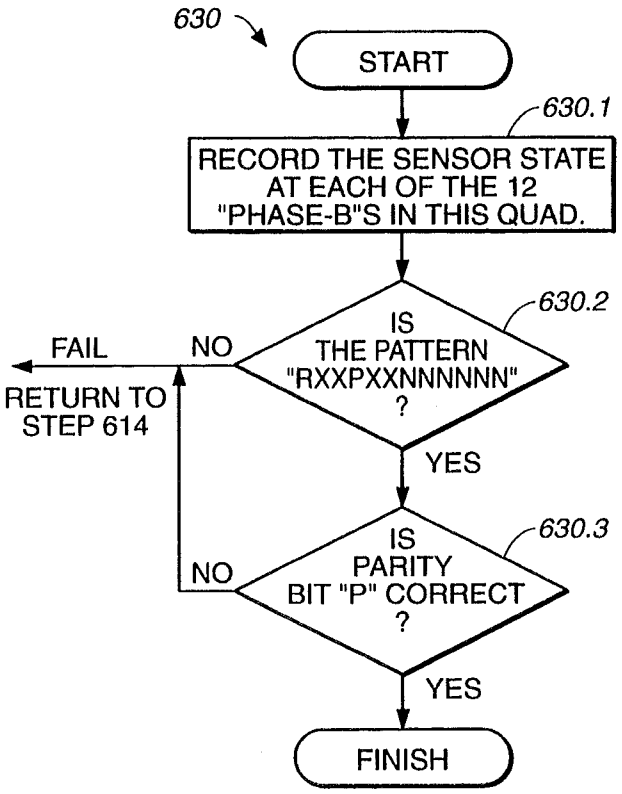

Step 630 (FIGS. 6, 13) consists of interpreting the next parity quad which has the pattern R P N N. The P bit is the parity bit. Based upon the 8-bit print wheel I.D. gathered at step 626 above, the print wheel I.D. is either accepted or rejected based upon the value of the parity bit.

At step 630.1, the sensor states are recorded at twelve consecutive phase-B's of the current quad. At step 630.2, the twelve states are compared to the pattern RXXPXXNNNNNN, where P and X can be any value. If a match is not found, control returns to step 614. If a match is found, at step 630.3 the parity bit P is checked against the data parity. If the parity is correct, step 630 terminates successfully and control proceeds to step 634. Otherwise control returns to step 614.

Figure 14:
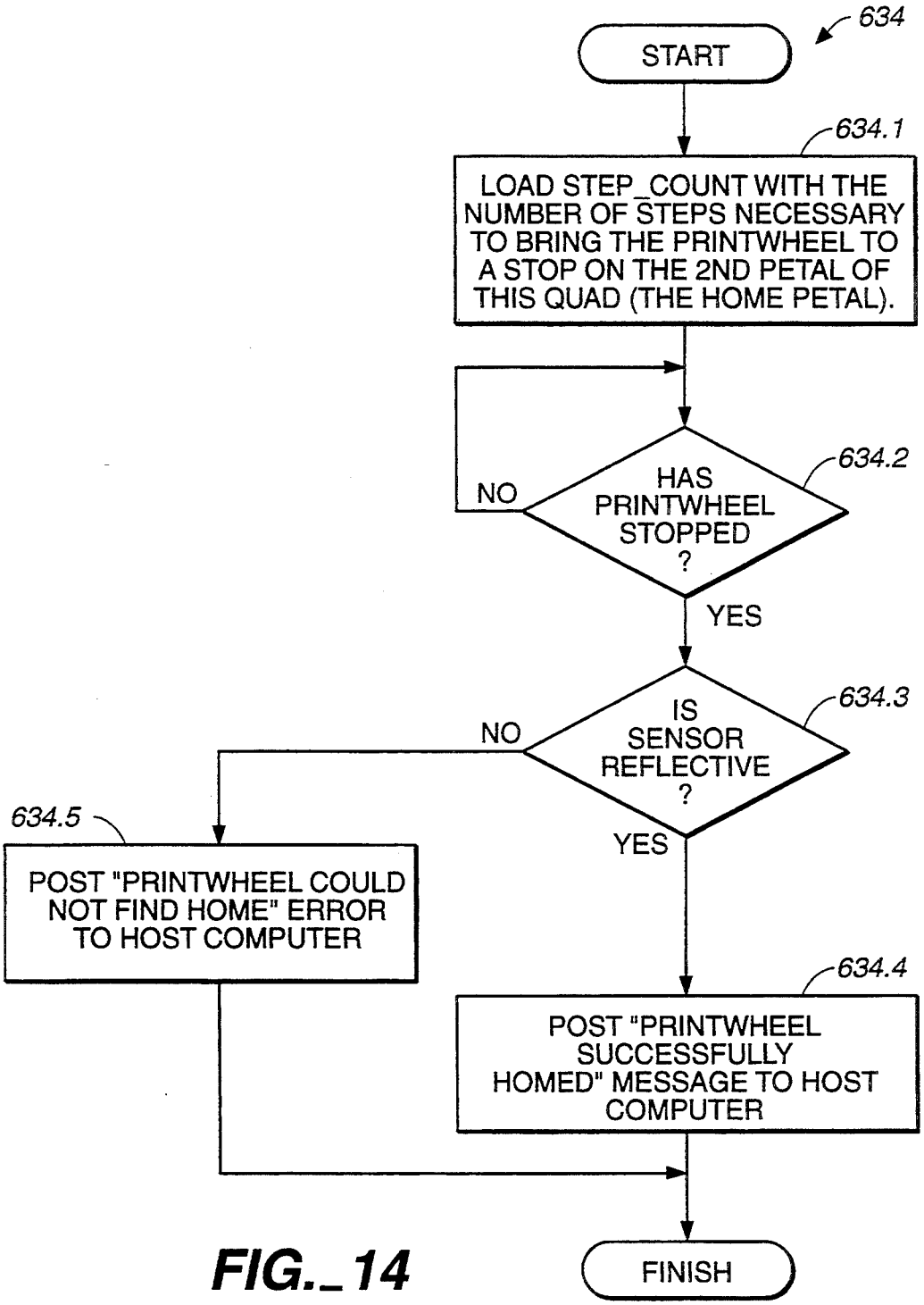

Step 634 (FIGS. 6, 14) is the final stage of the print wheel homing process. As mentioned above, the location of the sync patterns "fixes" the stopping position of the print wheel (its "home" position). When the print wheel comes to a stop, the petal underneath the sensor (corresponding to the home position) MUST be reflective. If it is not, the homing process fails and an error is reported to the host computer. Otherwise, the homing process is successful.

At step 634.1, variable STEP_CNT is loaded with the number of steps necessary to bring the print wheel to a stop on the second petal of the home quad. At step 634.2, a motor is advanced and, concurrently, STEP_CNT is decremented on each motor step until STEP_CNT=0. The print wheel is then stopped, and the sensor is read at 634.3. If the sensor state is reflective, the message "print wheel successfully homed" is sent to the host computer at step 634.4 and the homing process successfully terminates. If the sensor state is non-reflective, an error message is sent to the host computer at step 634.5 and the homing process terminates unsuccessfully.

DETECTING PRINT WHEEL FAULTS

One approach to monitoring the sensor feedback to detect a jammed print wheel condition is to read the sensor at each petal position during the first few petals of a multi-petal move (or "seek"). For example, for a 30-petal rotational move, the sensor is read at each of the first 5 petals. If the state of the sensor fails to change and remains either reflective or non-reflective on the five petals, then a jam has occurred. The print wheel motion is stopped immediately (truncating the rest of the move), and an error is reported to the host computer.

Suppose, however, that the motor is attempting to drive the print wheel while the print wheel is mechanically jammed. This creates vibrations which could cause the sensor to see a random pattern as a reflective strip vibrates in and out of the sensor's field of view, and it is possible that the jam would not be detected.

Thus, in some embodiments the following approach is used. As illustrated by Table 1 above, only certain reflective/non-reflective sequences are valid as the print wheel rotates. For example, starting from petal 1 and going in the direction of increasing petal numbers (clockwise, as the print wheel rotates counterclockwise), the following sequence is seen:

R N N N R . . .

Starting from petal 33 and going in the same direction, the following sequence is seen:

R R N N R . . .

In general, when going in the direction of increasing petal numbers starting on a marker strip R, only the following pattern is legal:

R X N N R X N N R X N N R . . . , where X="don't care", or

0 X 110 X 110 X 110. . . , in terms of binary numbers.

By similar reasoning, when going in the direction of decreasing petal numbers starting on a marker strip R, only the following pattern is legal:

R N N X R N N X R N N X R . . . , where X="don't care", or 0 11 X 0 11 X 0 11 X 0 . . . , in terms of binary numbers.

When monitoring the beginning of a print wheel seek, one determines if the seek is valid by observing the initial state of the print wheel sensor along with its state for the first 4 petal increments. In the direction of increasing petal numbers, the four possible valid patterns are, depending upon the initial starting petal:

| | |
|---|---|
| GENERAL PATTERN: | 0 X 1 1 0 X 1 1 0 X 1 1 0 . . . |
| VALID PATTERN #1 | 0 X 1 1 0 |
| VALID PATTERN #2 | X 1 1 0 X |
| VALID PATTERN #3 | 1 1 0 X 1 |
| VALID PATTERN #4 | 1 0 X 1 1 |

(Note that if this sequence were continued, the next valid pattern would be a duplicate of Valid Pattern #1 and thus would be redundant.)

By similar reasoning, in the direction of decreasing petal numbers, the four possible valid patterns are, depending upon the initial starting petal:

| | |
|---|---|
| GENERAL PATTERN: | 0 1 1 X 0 1 1 X 0 1 1 X 0 . . . |
| VALID PATTERN #5 | 0 1 1 X 0 |
| VALID PATTERN #6 | 1 1 X 0 1 |
| VALID PATTERN #7 | 1 X 0 1 1 |
| VALID PATTERN #8 | X 0 1 1 X |

By expanding the "don't care" ("X") conditions, all possible valid codes (i.e. patterns) can be enumerated as shown in the following Table 2.

TABLE 2

| VALID PATTERN # | DIRECTION | FORMAT | EXPANDS TO |
|---|---|---|---|
| #1 | increasing | 0 X 1 1 0 | 0 0 1 1 0 |
| | | | 0 1 1 1 0 |
| #2 | increasing | X 1 1 0 X | 0 1 1 0 0 |
| | | | 0 1 1 0 1 |
| | | | 1 1 1 0 0 |
| | | | 1 1 1 0 1 |
| #3 | increasing | 1 1 0 X 1 | 1 1 0 0 1 |
| | | | 1 1 0 1 1 |
| #4 | increasing | 1 0 X 1 1 | 1 0 0 1 1 |
| | | | 1 0 1 1 1 |
| #5 | decreasing | 0 1 1 X 0 | 0 1 1 0 0 |
| | | | 0 1 1 1 0 |
| #6 | decreasing | 1 1 X 0 1 | 1 1 0 0 1 |
| | | | 1 1 1 0 1 |
| #7 | decreasing | 1 X 0 1 1 | 1 0 0 1 1 |
| | | | 1 1 0 1 1 |
| #8 | decreasing | X 0 1 1 X | 0 0 1 1 0 |
| | | | 0 0 1 1 1 |
| | | | 1 0 1 1 0 |
| | | | 1 0 1 1 1 |

Table 2 lists all the VALID codes, based upon the direction of print wheel rotation. The INVALID codes are obtained by listing all possible 5 bit patterns NOT in Table 2, for each direction along the print wheel. Each direction contains 10 valid binary sequences. Hence each direction has 22 invalid binary sequences ($32-10=22$, where $32=2^5$). The following Table 3 lists the invalid binary codes for each direction of print wheel rotation.

TABLE 3

| INCREASING DIRECTION INVALID CODES | DECREASING DIRECTION INVALID CODES |
|---|---|
| 0 0 0 0 0 | 0 0 0 0 0 |
| 0 0 0 0 1 | 0 0 0 0 1 |
| 0 0 0 1 0 | 0 0 0 1 0 |
| 0 0 0 1 1 | 0 0 0 1 1 |
| 0 0 1 0 0 | 0 0 1 0 0 |
| 0 0 1 0 1 | 0 0 1 0 1 |
| 0 0 1 1 1 | 0 1 0 0 0 |
| 0 1 0 0 0 | 0 1 0 0 1 |
| 0 1 0 0 1 | 0 1 0 1 0 |
| 0 1 0 1 0 | 0 1 0 1 1 |
| 0 1 0 1 1 | 0 1 1 0 1 |
| 0 1 1 1 1 | 0 1 1 1 1 |
| 1 0 0 0 0 | 1 0 0 0 0 |
| 1 0 0 0 1 | 1 0 0 0 1 |
| 1 0 0 1 0 | 1 0 0 1 0 |
| 1 0 1 0 0 | 1 0 1 0 0 |
| 1 0 1 0 1 | 1 0 1 0 1 |
| 1 0 1 1 0 | 1 1 0 0 0 |
| 1 1 0 0 0 | 1 1 0 1 0 |
| 1 1 0 1 0 | 1 1 1 0 0 |
| 1 1 1 1 0 | 1 1 1 1 0 |
| 1 1 1 1 1 | 1 1 1 1 1 |

The Table 3 list can be simplified by compiling a list of all codes which are invalid in both directions. The list is shown in Table 4 below. Note that the majority of invalid codes are common to both directions. This final list of invalid codes is monitored for, ignoring the direction of print wheel rotation.

TABLE 4

| COMMON INVALID CODES |
|---|
| 0 0 0 0 0 |
| 0 0 0 0 1 |
| 0 0 0 1 0 |
| 0 0 0 1 1 |
| 0 0 1 0 0 |
| 0 0 1 0 1 |
| 0 1 0 0 0 |

TABLE 4-continued

| COMMON INVALID CODES |
|---|
| 0 1 0 0 1 |
| 0 1 0 1 0 |
| 0 1 0 1 1 |
| 0 1 1 1 1 |
| 1 0 0 0 0 |
| 1 0 0 0 1 |
| 1 0 0 1 0 |
| 1 0 1 0 0 |
| 1 0 1 0 1 |
| 1 1 0 0 0 |
| 1 1 0 1 0 |
| 1 1 1 1 0 |
| 1 1 1 1 1 |

Of note, the first approach discussed above of simply detecting a jam when the sensor state remains either "reflective" or "non-reflective" on the first 5 petals corresponds to the illegal (invalid) codes (0 0 0 0 0) and (1 1 1 1 1) which are included in Table 4. Thus, using Table 4 results in a better detection of jams.

Further reduction of Table 4 is obtained by condensing the Table 4 list using the "don't care" ("X") notation where possible, as shown in the following Table 5:

TABLE 5

| COMMON INVALID CODES, CONDENSED WITH "X" NOTATION |
|---|
| 0 0 0 0 X |
| 0 0 0 1 X |
| 0 0 1 0 X |
| 0 1 0 0 X |
| 0 1 0 1 X |
| 0 1 X 1 1 |
| 1 0 0 0 X |
| 1 0 1 0 X |
| 1 1 0 X 0 |
| 1 1 1 1 X |

Thus by using the "X" ("don't care") notation, the list of invalid codes for seeks of 4 or more petals (not counting the petal which is underneath the sensor when the seek starts) is reduced to the 10 patterns of Table 5. In Table 5, eight of the 10 patterns end with a "don't care" bit. Hence these 8 patterns can be used to detect errors in seeks of 3 petals as well (again, not counting the petal which is underneath the sensor when the seek starts).

The subset of invalid codes for seeks of 3 petals in either direction is shown in the following Table 6.

TABLE 6

| SUBSET OF INVALID CODES FOR SEEKS OF 3 PETALS | | |
|---|---|---|
| 0 0 0 0 X, | or simply | 0 0 0 0 |
| 0 0 0 1 X, | or simply | 0 0 0 1 |
| 0 0 1 0 X, | or simply | 0 0 1 0 |
| 0 1 0 0 X, | or simply | 0 1 0 0 |
| 0 1 0 1 X, | or simply | 0 1 0 1 |
| 1 0 0 0 X, | or simply | 1 0 0 0 |
| 1 0 1 0 X, | or simply | 1 0 1 0 |
| 1 1 1 1 X, | or simply | 1 1 1 1 |

When the print wheel begins its rotation, the firmware monitors for these invalid codes by monitoring the initial state of the sensor and its state at each of the first 3 or 4 petals in the seek (not counting the initial petal). If the print wheel is to be rotated by three petals total, the Table 6 codes are used for monitoring. If the print wheel is rotated by four or more petals, the Table 5 codes are used. If an invalid pattern is detected, the print wheel rotation is immediately halted, and an error reported to the host computer. The operator can then take corrective action and either re-start printing, or abort the printing operation.

Anytime a print wheel seek is requested, a check is made to see whether feedback monitoring is required. If the seek is either 1 or 2 petals, monitoring is not done in the embodiment being described. In some embodiments, monitoring is done, for example, as follows. +1 seeks are monitored by performing a +5 seek and a −4 seek combination. +2 seeks are similarly monitored.

If the print wheel is jammed or experiences a momentary interference with the hammer or print wheel casing, this should be detectable by monitoring only the beginning of the motion, thus only the initial 3 or 4 petal states are monitored for seeks of 3 or more. Seeks of 3 petals record 4 states: the initial state of the sensor, and the state of the sensor as the print wheel rotates the 3 petals. Seeks of 4 or more petals record 5 states: the initial state of the sensor, and the state of the sensor as the print wheel rotates the first 4 petals of the seek.

Figures 15, 16, 17:
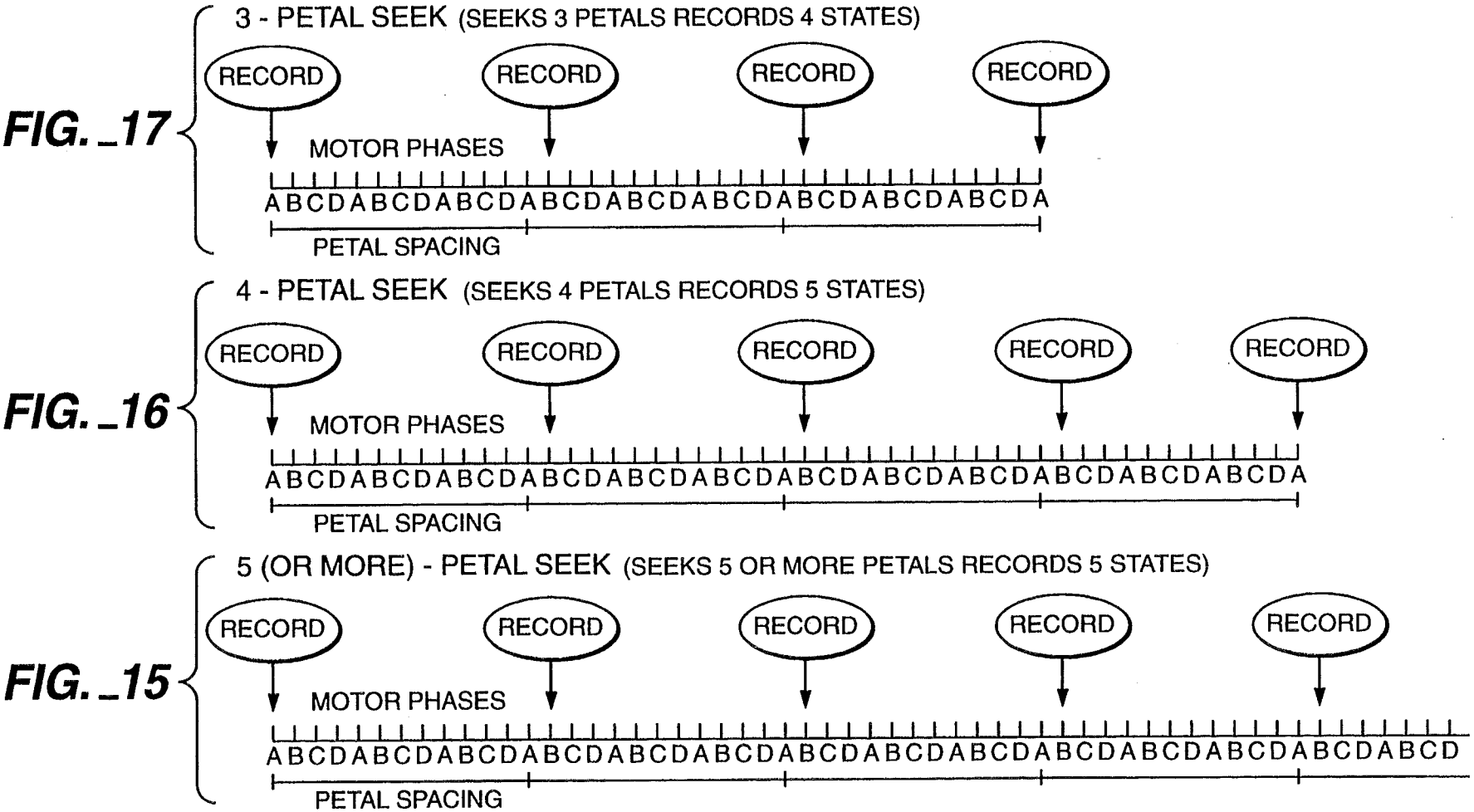
FIGS. 15–17 illustrate points at which print wheel sensor is read during petal seeks to perform error detection.

The initial state of the sensor is recorded before motion begins, and thus occurs on the electrical A phase. The remaining sensor states are recorded on every twelfth electrical B phase thereafter when rotating in the "homing" direction, or on every twelfth electrical D phase when rotating in the opposite direction. This is due to the fact that the print wheel motor's mechanical position lags its electrical position by approximately one motor step (as discussed earlier). Every twelfth phase is recorded because the print wheel petal centerlines occur every 12 motor steps. See FIG. 15 showing the phase recordation in the homing direction. However, the first recordation is done at the initial electrical phase A when the print wheel is at rest, and hence the second recordation is done 13 electrical steps after the first recordation.

Seeks of 3 and 4 are treated specially. The final recordation occurs on the electrical (and mechanical) phase A when the print wheel is at rest as shown in FIG. 16 for seeks of 4 and FIG. 17 for seeks of 3. Thus the final recordation occurs 11 electrical steps after the previous recordation.

Figure 18:
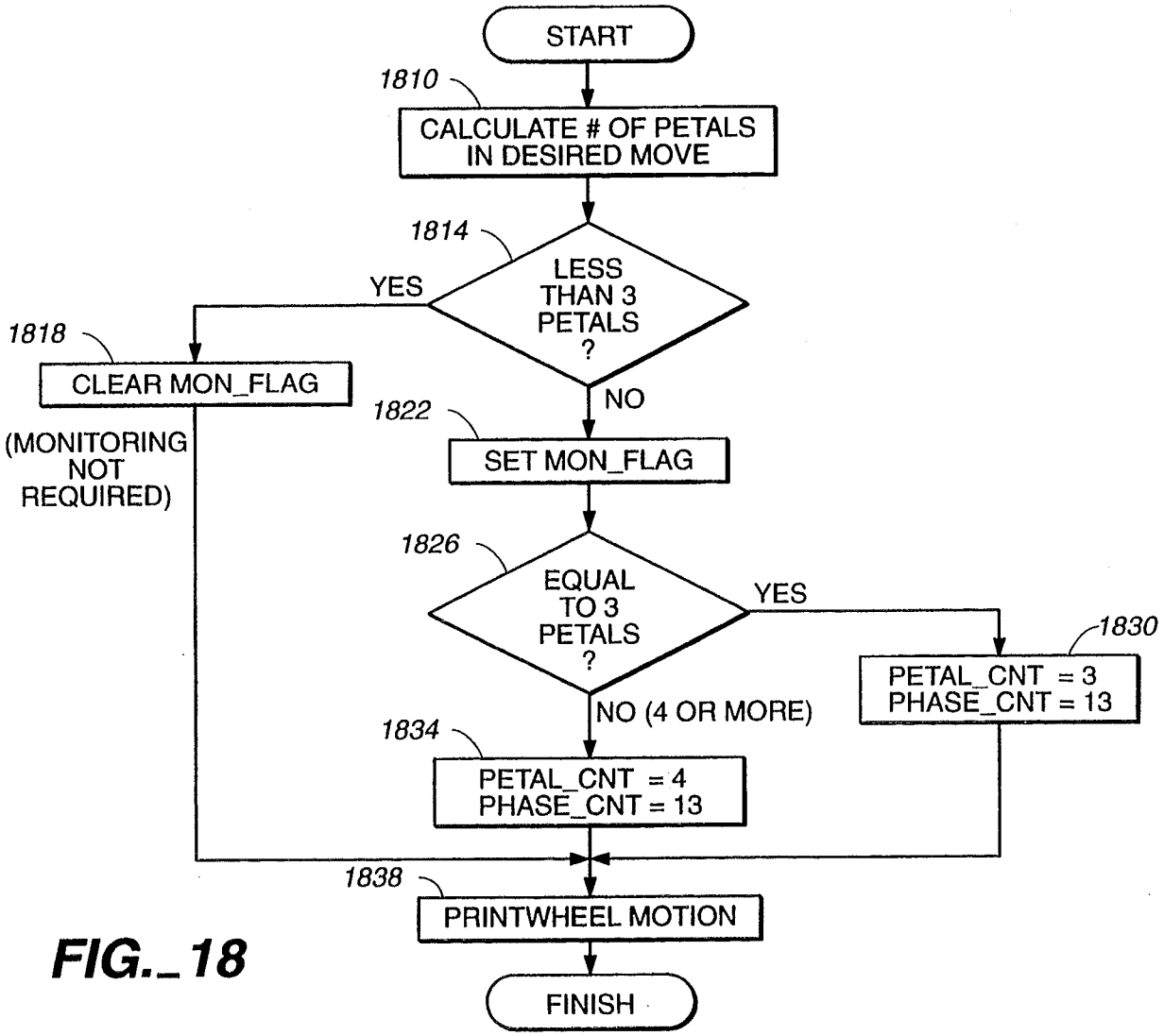
FIGS. 18,19,19A and 19B are flow charts of the printer firmware portion performing petal seeks.
Figures 19, 19A, 19B:
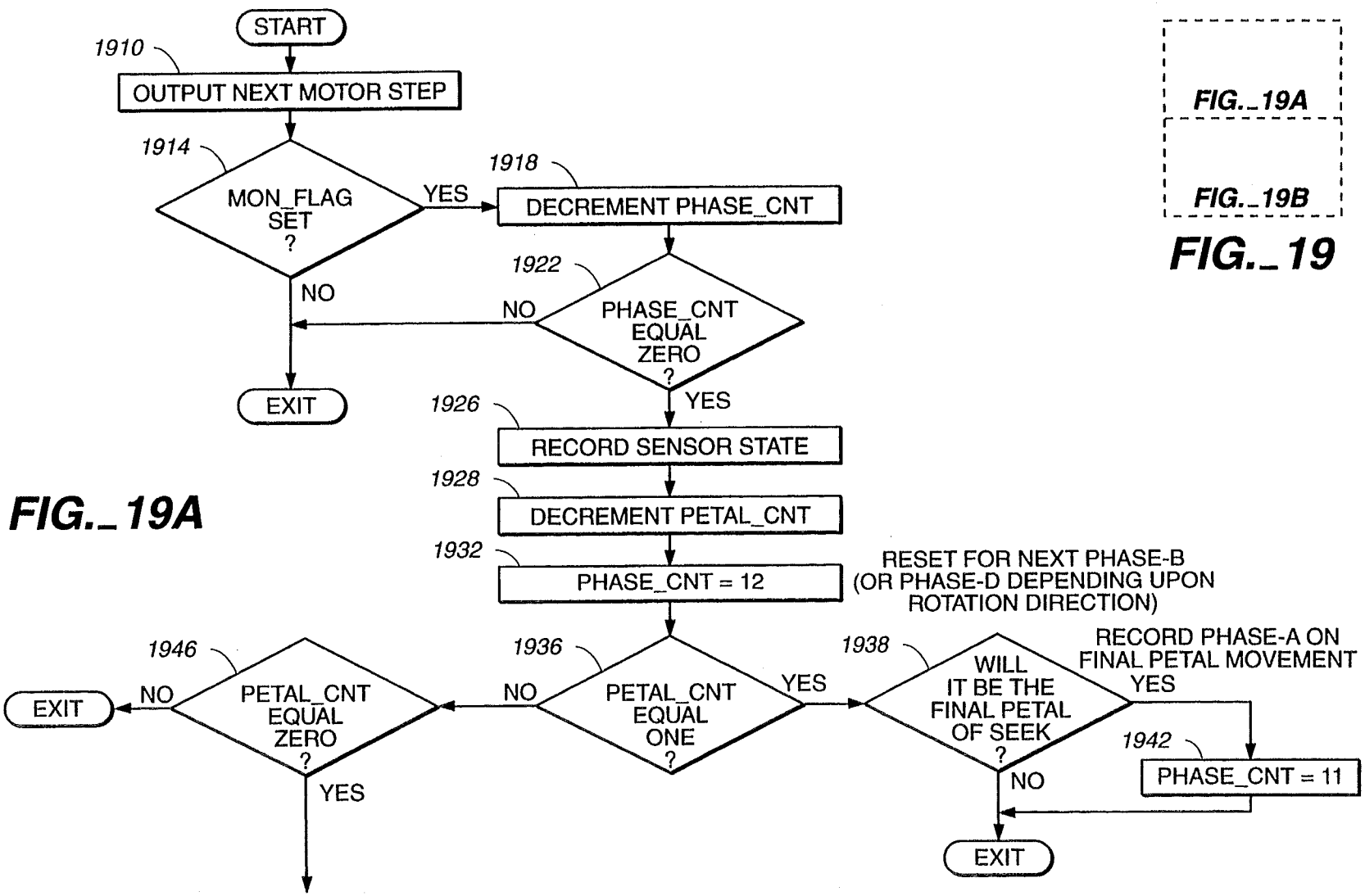
Figure 19B:
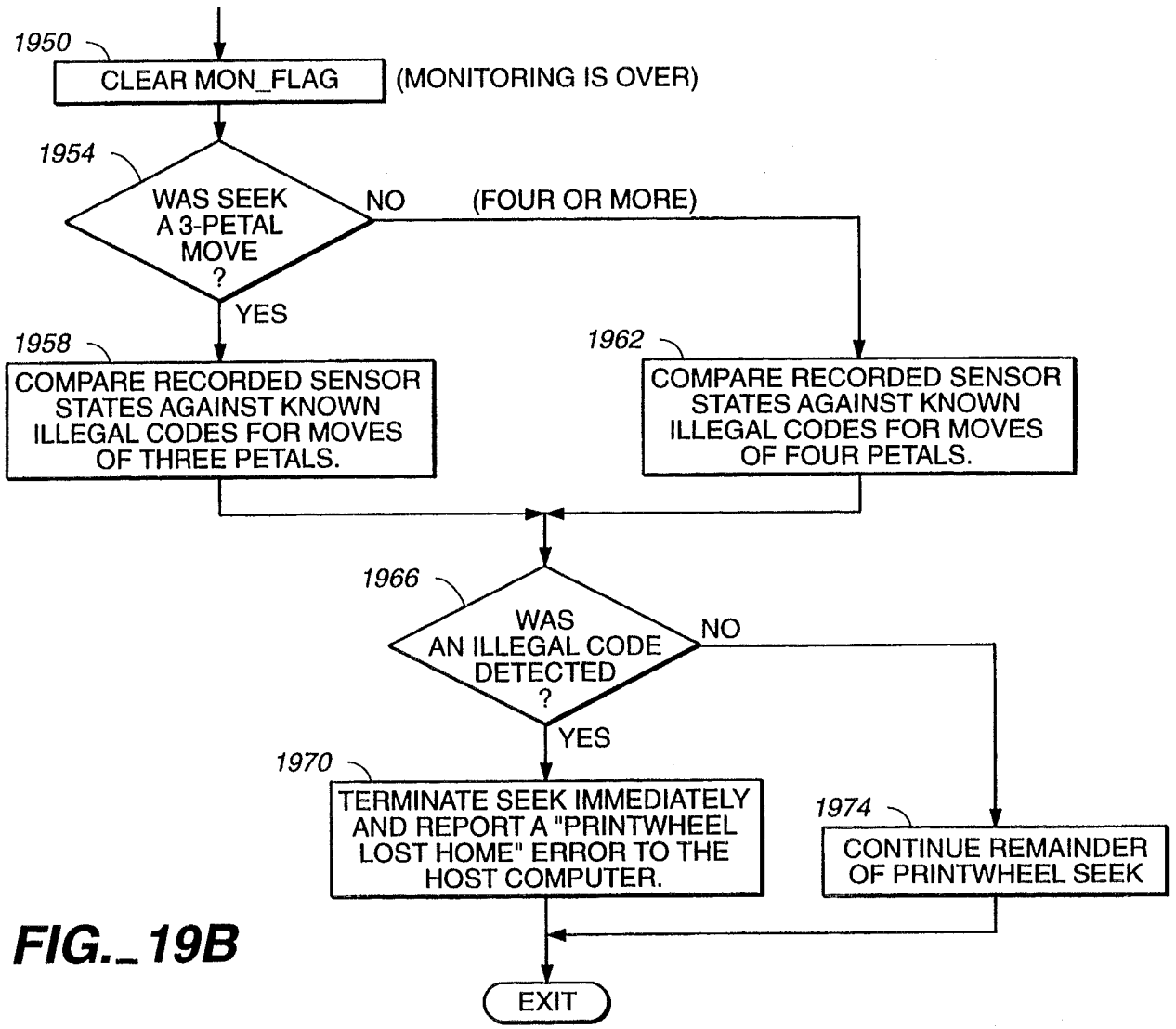

The sensor monitoring during print wheel seeks is illustrated in FIGS. 18 and 19. At step 1810, the number of petals in the desired move is determined. If the number of petals is less than 3 (step 1814), a flag MON_FLAG is cleared to indicate that the sensor monitoring is not to be performed. Otherwise, at step 1822, the flag MON_FLAG is set. If the number of petals in the desired move is 3 (step 1826), control passes to step 1830. The variable PETAL_CNT is set to 3. The variable PHASE_CNT is set to 13 to indicate that the next sensor state to be recorded is thirteen motor steps away from the current phase A. See FIGS. 15–17.

If the number of petals in the desired move is greater than 3, control passes to step 1834. The variable PETAL_CNT is set to 4 to indicate that four petals in addition to the current petal will be monitored. PHASE_CNT is set to 13.

Control from steps 1834 and 1830 passes to step 1838 at which the print wheel is moved and monitoring is performed.

FIG. 19 illustrates the firmware operation at each motor step during the firmware step 1838. At step 1910, the firmware issues a motor step to the motor. At step 1914, flag MON_FLAG is checked. If the flag is not set, the firmware operation for the current step terminates. The flag is not set if the current seek is of one or two petals or if the monitoring has terminated.

At step 1918, PHASE_CNT is decremented. If PHASE_CNT is not zero (step 1922), the firmware operation for the current motor step terminates. Otherwise, the sensor state is recorded at step 1926. PETAL_CNT is decremented at step 1928. Then the number of phases (motor steps) is computed to the next sensor state to be recorded. At step 1932, PHASE_CNT is set to 12. This operation assumes that the next sensor state is to be recorded in 12 motor steps. If PETAL_CNT=1 (step 1936), that is, the next petal is the final petal to be monitored, control passes to step 1938. If the next petal is the final petal of the seek, PHASE_CNT is set to 11 (step 1942) to indicate that the next sensor state to be recorded is at the electrical phase A of the next petal. See FIGS. 16 and 17. Otherwise, the firmware operation for the current motor step terminates with PHASE_CNT=12.

If at step 1936 PETAL_CNT is not equal to 1, control passes to step 1946. If PETAL_CNT is not equal to 0, the firmware operation for the current motor step terminates. Otherwise, if PETAL_CNT=0, MON_FLAG is cleared at step 1950 to indicate that the monitoring will not be performed for the remaining petals of the seek.

If the seek was a 3-petal seek (step 1954), the recorded sensor states are compared against the invalid codes from Table 6 above (step 1958). If the seek was a 4 or more petal seek, the recorded sensor states are compared against the invalid codes of Table 5 (step 1962). If a match is found (step 1966), the seek is terminated if it has not already terminated, and the host computer is notified of an error in the print wheel subsystem. See step 1970. The operator can then take corrective action and re-start the printing process, or can abort it.

If a match is not found at step 1958 or 1962, the seek is allowed to continue (step 1974).

The techniques described above provide a robust print wheel subsystem with reliable motion fault detection. The sensor feedback is available throughout the entire 360 degrees of rotation. In addition to detecting jam conditions, this feedback scheme can also detect occurrences of a print wheel being knocked off position by as little as 4 motor steps (one motor "detent"). The print wheel can be knocked off due to, for example, a momentary mechanical interference between the print wheel and the hammer or the print wheel casing. The print-wheel-knocked-off condition can be detected due to the fact that future print wheel seeks will start from an invalid initial condition (a "wrong" A-phase), resulting in invalid reflective/non-reflective sequences during motion. The ability to detect these kinds of errors and thus prevent potentially harmful print actions greatly increases the protection afforded to the print wheels.

While the invention has been illustrated with respect to the embodiments described above, other embodiments and variations are within the scope of the invention. For example, in some embodiments, each group of consecutive reflector strips includes only three strips, for example, each group has the form RYN when the print wheel is read in the clockwise direction. In other embodiments, each group has the form NYR if the print wheel is read in the clockwise direction. Other groups of three or more strips are used in other embodiments, for example, groups RRYN and RYYN are used in some embodiments.

In some embodiments, the print wheel is monitored on every petal move during seeks. More particularly, when the firmware reads the print wheel I.D., the firmware creates a complete map of the encoder ring, thus defining the sensor state for every print wheel position. The sensor is read on every motor step, or, alternatively, whenever the sensor is supposed to be aligned with a petal centerline. Early and reliable error detection is thereby provided.

In some embodiments, non-optical signs are used instead of reflector strips. For example, magnetic signs are used in some embodiments. R corresponds to one magnetic polarity, and N corresponds to the other polarity.

The invention is not limited by the number of motor steps between petals, the number of motor steps per print wheel revolution, the number of print wheel petals, or any particular type of the microprocessor and other components. Other embodiments and variations are within the scope of the invention as defined by the following claims.

What is claimed is:

1. A print wheel comprising:

a center portion;

a plurality of petals having characters thereon, the petals extending radially from the center portion; and a plurality of signs running along the center portion generally circularly in one plane with the petals, each sign being either a predetermined sign S1 or a predetermined sign S2, the signs being in groups of three or more consecutive signs, each group containing a unique variable bit of information, each group when examined in sequence in a predetermined circular direction comprising:

one or more consecutive signs S1 marking a beginning of the group; p2 one or more identical consecutive signs "I" following said one or more signs S1, each sign "I" being one of S1 and S2, the signs "I" providing the unique bit of information; and one or more consecutive signs S2 which follow said one or more signs "I" and which mark an end of the group, wherein a sign sequence "S2 S1" identifies the end of one group and the beginning of another group to allow a print engine to synchronize with the groups.

2. The print wheel of claim 1 wherein one of said signs is provided at every petal of the print wheel.

3. The print wheel of claim 1 wherein in each group the one or more consecutive signs S1 comprise only one sign S1.

4. The print wheel of claim 1 wherein in each group the one or more identical signs "I" comprise only one sign "I".

5. The print wheel of claim 1 wherein in each group the one or more signs S2 comprise exactly two signs S2.

6. The print wheel of claim 1 wherein said groups when examined in sequence in the predetermined circular direction include:

a predetermined number of consecutive marker groups in which all the signs "I" are equal to a predetermine marker sign such that any sequence of consecutive groups which are not marker groups and whose signs "I" are equal to the predetermined marker sign has fewer groups than the predetermined number of the marker groups, so that any sequence of the predetermined number of groups with all their signs "I" equal to the predetermined marker sign is unique identifiable as a sequence of marker groups;

one or more sync groups following consecutively the marker groups in the predetermined circular direction such that in each sync group each sign "I" is different from each sign "I" of each marker group; and one or more data groups whose signs "I" define a print wheel identification code, the sync groups signaling a transition between the marker groups and the data group.

7. The print wheel of claim 6 wherein said groups of signs include a home group in which each sign "I" is equal to each sign "I" of each sync group.

8. The print wheel of claim 6 wherein said groups of signs include a parity group for checking the parity of the data groups.

9. The print wheel of claim 1 wherein one of said signs S1, S2 is a reflective strip readable by an optical sensor and the other one of said signs S1, S2 is non-reflective strip readable by an optical sensor.

* * * * *

UNITED STATES PATENT AND TRADEMARK OFFICE

CERTIFICATE OF CORRECTION

PATENT NO. : 5,413,422

DATED : May 9, 1995

INVENTOR(S) : Roger M. Gray and Warren K. Shannon

It is certified that error appears in the above-indentified patent and that said Letters Patent is hereby corrected as shown below:

Col. 9, lines 26-27
after "1,000." delete "STEP COUNT" and insert --STEP_COUNT--.

Col. 9, line 30
delete "STEP COUNT" and insert --STEP_COUNT--.

Col. 9, line 39
delete "STEP COUNT" and insert --STEP_COUNT--.

Col. 17, line 37
delete "p2".

Col. 18, line 18
delete "predetermine" and insert --predetermined--.

Signed and Sealed this

Second Day of April, 1996

Bruce Lehman

*Attest:*

BRUCE LEHMAN

*Attesting Officer*

*Commissioner of Patents and Trademarks*